US007721667B2

(12) United States Patent
Kaemmerling

(10) Patent No.: US 7,721,667 B2
(45) Date of Patent: May 25, 2010

(54) WATERCRAFT FENDER

(76) Inventor: Thomas Robert Kaemmerling, N85 W17228 Ann Ave., Menomonee Falls, WI (US) 53051

( * ) Notice: Subject to any disclaimer, the term of this patent is extended or adjusted under 35 U.S.C. 154(b) by 12 days.

(21) Appl. No.: 12/148,258

(22) Filed: Apr. 18, 2008

(65) Prior Publication Data

US 2009/0260558 A1 Oct. 22, 2009

(51) Int. Cl.
*B63B 59/02* (2006.01)

(52) U.S. Cl. ..... 114/219

(58) Field of Classification Search ..... 114/219, 114/266, 267; 405/212–215
See application file for complete search history.

(56) References Cited

U.S. PATENT DOCUMENTS 1,220,876 A 3/1917 Moore
2,179,125 A * 11/1939 Kirlin ..... 114/219
3,797,435 A 3/1974 Dunson
3,988,997 A 11/1976 Fenton
4,843,992 A * 7/1989 Babikian ..... 114/69
6,080,027 A * 6/2000 Rodemann ..... 441/41

* cited by examiner

*Primary Examiner*—Ed Swinehart
(74) *Attorney, Agent, or Firm*—Absolute Technology Law Group, LLC

(57) ABSTRACT

A portable fender for protecting a watercraft hull from damage. The fender(s) length corresponds to the length of the watercraft likely to make contact with a dock, pier and/or pilings. An inflatable, waterproof bladder resides in a protective cover. The bladder's valve permits rapid inflation and deflation. The cover has diametrically opposed straps running its length. These straps are anchored to the cover in such a manner that loops are created at regular intervals. Mooring straps are passed through the loops and around the fender. The fender is secured between the watercraft and the dock/pier/pilings by attaching mooring straps to any convenient point on the watercraft, dock, pier, pilings or other suitable mooring point. Lengthening or shortening each individual mooring strap allows the fender to be placed in a position that will provide optimum protection. The fender is easily deflated for stowage. The watercraft does not have to be modified in any manner to use the fender.

9 Claims, 12 Drawing Sheets

WATERCRAFT FENDER

FIELD OF THE INVENTION

The present invention relates to watercraft fenders and, more particularly, to a portable method of watercraft protection from dock abrasion despite differences in dock height or type of dock construction.

BACKGROUND OF THE INVENTION

Boat docks come in many styles and sizes. Many incorporate a structural design in which the pilings are located externally to the dock's side rails. When the length of the watercraft exceeds the length between the pilings, the watercraft must be moored against these external pilings. Therefore, a gap is created between the side of the watercraft and the side (rail) of the dock itself. Ordinary fenders, due to their inherent size and shape, fall into this gap negating any protection. If one attempts to place ordinary fenders between the watercraft and the pilings themselves, the fenders tend to roll out of place due to wave action. Additionally, if the side of the dock is higher than the gunwale, ordinary fenders do not prevent the craft from riding up and under the dock, causing further damage.

Ordinary fenders are bulky, difficult to stow and require multiple units of various sizes to remedy the unlimited variations in dock length, dock height and dock rail-to-hull distance. They are difficult to adjust, have limited attachment points on the watercraft, are bulky and difficult to stow. Other fill-length fenders require ballast, modification of the watercraft or permanent mounting to the watercraft.

U.S. Pat. No. 1,220,876—Attachment for Boat.

U.S. Pat. No. 3,797,435—Emergency Flotation Apparatus for Watercraft.

U.S. Pat. No. 3,988,997—Boat Fender.

U.S. Pat. No. 1,220,876 was designed as a buoyancy compensator for inflatable military craft. This device has four major shortcomings:

1) The patent has since expired.

2) The bladder of the device is elongated as opposed to round or nearly-round. This shape would permit the bladder to float on its flattest side, reducing the level of protection. The oblong shape also creates an uneven pressure levels on the seams, thus increasing the potential for seam failure.

3) The device is for use on inflatable boats: a limited application.

4) The device requires high inflation pressures. Specialized inflation equipment must be available. There is also and increased danger of seam failure and/or explosion.

U.S. Pat. No. 3,797,435 was designed as an Emergency Flotation Apparatus for Watercraft. This device has five major shortcomings:

1) The device is designed for temporary and/or permanent attachment to the craft and involves modifying the hull of the craft with various mounting devices. As one is altering the hull, there is the possibly of diminishing hull integrity. The device may require professional installation. Permanent installation may impede watercraft performance. Permanent installation detracts from the watercraft's appearance.

2) The device requires the use of heavy and dangerous to stow compressed bottle gas for inflation.

3) The bladder of the device is elongated as opposed to round or nearly-round. This shape would permit the bladder to float on its flattest side, reducing the level of protection. The oblong shape also creates an uneven pressure levels on the seams, thus increasing the potential for seam failure.

4) Due to the mounting method, the height of the bladder is not readily adjustable over the length of the watercraft.

5) Due to the mounting method, the fender cannot be employed on the dock or pier in lieu of the watercraft if the situation warrants.

U.S. Pat. No. 3,988,997 Boat Fender, was designed to protect the hull of a boat for use while traversing through locks. This device has five major shortcomings for my intended purpose.

1) The device is designed for temporary and/or permanent attachment to the craft and involves modifying the hull of the craft with various mounting devices. As one is altering the hull, there is the possibly diminishing hull integrity. The device may require professional installation. Permanent installation may impede watercraft performance. Permanent installation detracts from the watercraft's appearance.

2) The device requires a second, ballasted bag for proper function. This appendage obstructs portability and inhibits ease of use for the recreational boater.

3) The device requires a high-pressure tire inflator for inflation. Small, portable tire inflators inflate too slowly for recreational boating use. Tire inflators require a specialized valve. High volume tire inflators are bulky, heavy and are not practical to keep aboard the average recreational boat.

4) Due to the ballasted bag assembly, function of the device would be impaired as the height of the bladder would not be adjustable over the length of the watercraft.

5) Due to the mounting method, the fender cannot be employed on the dock or pier in lieu of the watercraft if the situation warrants.

It is therefore an object of the invention to provide watercraft hull protection to the entire hull section adjacent to dock/pier rails or dock pilings.

It is another object of the invention that the protection device does not fall between pilings.

It is another object of the invention that the device provides protection from pilings when there are no dock or pier rails present between pilings.

It is another object of the invention to be easily and rapidly inflated using commercially available low-pressure inflators.

It is another object of the invention to be easily and rapidly deflated.

It is another object of the invention to be quickly and easily adjustable along its length with a series of individually adjustable straps.

It is another object of the invention to be quickly and easily attached to a watercraft, dock, pier or other mooring point.

It is another object of the invention to be quickly and easily detached from a watercraft, dock, pier or other mooring point.

It is another object of the invention that in operation, the watercraft does not have to be modified in any manner.

It is another object of the invention to be quickly and easily folded for stowage.

SUMMARY OF THE INVENTION

In accordance with the present invention, there is provided an inflatable, round or nearly round, airtight, waterproof bladder residing in a rugged, non-marring covering. This bladder and cover combination will be referred to as "fender". The length of the fender(s) should approximate the length of the watercraft's hull likely to make contact with a dock, pier or pilings. The bladder is equipped with a valve that permits fast, easy, low-pressure inflation and rapid deflation from any number of commercially available inflators. The cover has two or more diametrically opposed looped straps that run its length. A number of mooring straps are inserted perpendicularly through the integrated loops sewn into the straps on the cover. Stops are sewn incrementally over the length of the cover's straps to prevent the mooring straps from sliding down the length of the fender. Using fasteners, the mooring straps are secured to user-selected mounting points on the watercraft (i.e. cleats, railings, windshield, etc.), and/or to the dock or pier. Lengthening or shortening the individual mooring strap allows the fender to be placed in any position alongside the hull that provides optimum protection. When deflated, the fender may be folded for easy stowage. The watercraft does not have to be modified in any manner to utilize the fender.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
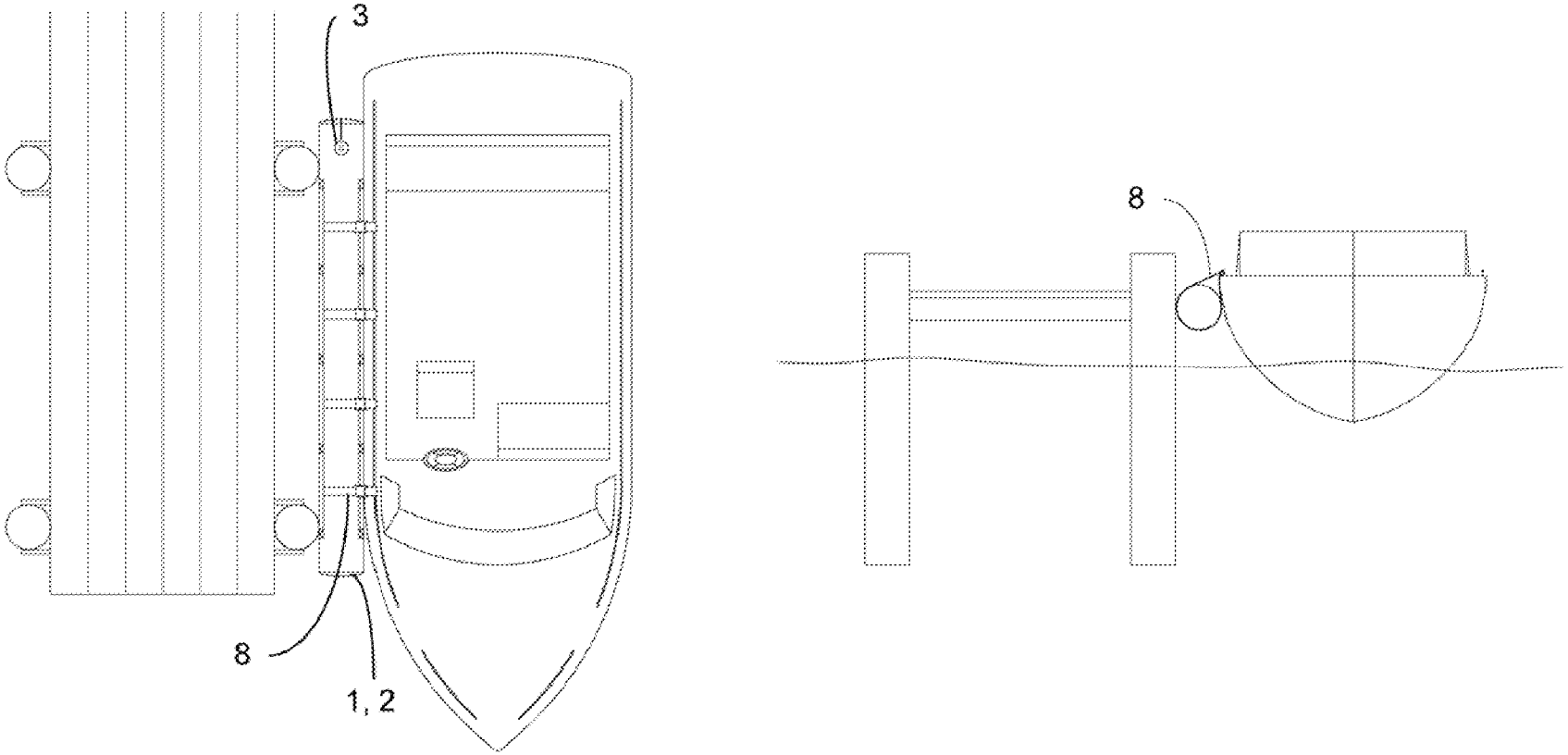
FIG. 1 is an application view of a watercraft fender in accordance with the invention.

FIG. 1 is an application view of a boat fender in accordance with the invention. An inflatable bladder (2) resides within a protective cover (1). The cover/bladder assembly is heretofore referred to as "fender". The length of the fender will vary with the length of the watercraft on which it will be utilized: ideally the length of the longest straight section of the watercraft that is likely to make contact with a dock, pier and/or pilings. Several fenders may be utilized for longer watercraft. The diameter of the fender will also vary with the size of the watercraft. The watercraft does not have to be modified in any manner to utilize the fender.

In operation, the watercraft is brought alongside the dock or pier to which it is to be moored. The fender is inflated and placed between the watercraft's hull and the dock or pier. If the dock has external pilings, or the rails of the dock or pier are above the gunwale, the watercraft is situated so that the longest straight section of the watercraft's hull is centered between any two pilings. The fender is inflated and placed between the watercraft's hull pilings. Mooring straps (8), passed through loops (7) on the cover (1), are then routed through or around suitable attachment points on the watercraft (cleats, railings, windshield frame, etc.) and/or the dock or pier. Each mooring strap (8) is then secured by fastening the integrated buckle or other suitable closure device. Lengthening or shortening each individual mooring strap (8) will allow the fender to be placed at the most advantageous position along the side of the hull with respect to the dock, pier or pilings in such a manner that the fender will provide optimum hull protection. When not in use, the mooring straps (8) are released. The valve (3) is opened allowing the fender to quickly deflate. The fender and its accompanying mooring straps (8) may then be folded for stowage.

Figure 2:
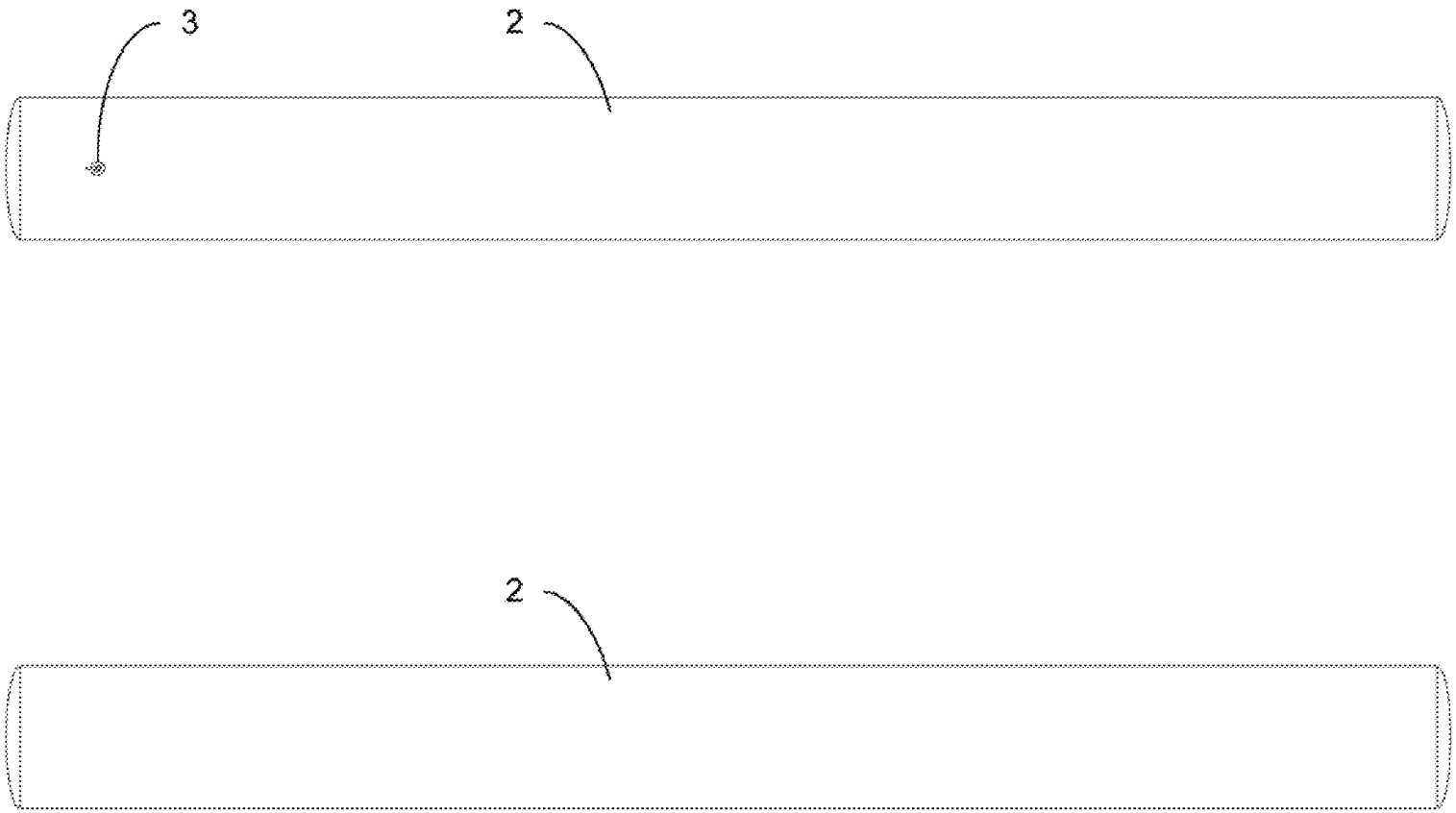
FIG. 2 is a top and bottom view of a bladder.

FIG. 2 is a top and bottom view of a bladder (2). The bladder (2) serves three purposes: 1) It gives the fender its shape; 2) Its inherent length spans the distance between external pilings (FIG. 1) creating a buffer between the watercraft and the pilings; 3) It acts as a shock absorber. The bladder (2) is airtight, heavy-duty, lightweight, waterproof and buoyant. It may be constructed of PVC or any other suitable material. The seams are secured in such a manner that the bladder (2) remains airtight and watertight. The size of the bladder (2) is such that it fits snuggly inside of the cover (1) thus minimizing movement within the cover (1). The length of the bladder/cover combination will vary with the length and weight of the watercraft to which it will be attached. The diameter of the bladder/cover combination will vary with the length and weight of the watercraft to which it will be attached.

The Boston-style or other suitable valve (3) is welded or otherwise secured to the bladder (2) in such a manner that it is airtight and watertight.

In operation, the bladder (2) is inserted into the cover (1) in such a manner that the valve's cap protrudes through the valve access (4). The bladder (2) is held inside the cover (1) by securing the bladder access (5).

Because of its multiple built-in adaptors, the Boston-style valve (3) accepts any number of readily available, low pressure, electric or manual inflators. Using low-pressure inflators not only makes it difficult to over-inflate the bladder (2), but also provides optimum flexibility of inflation methods. The bladder (2) may also be inflated by mouth. Unscrewing the entire one-way valve assembly of the Boston-style valve (3) allows the fender to deflate very rapidly.

Figure 3:
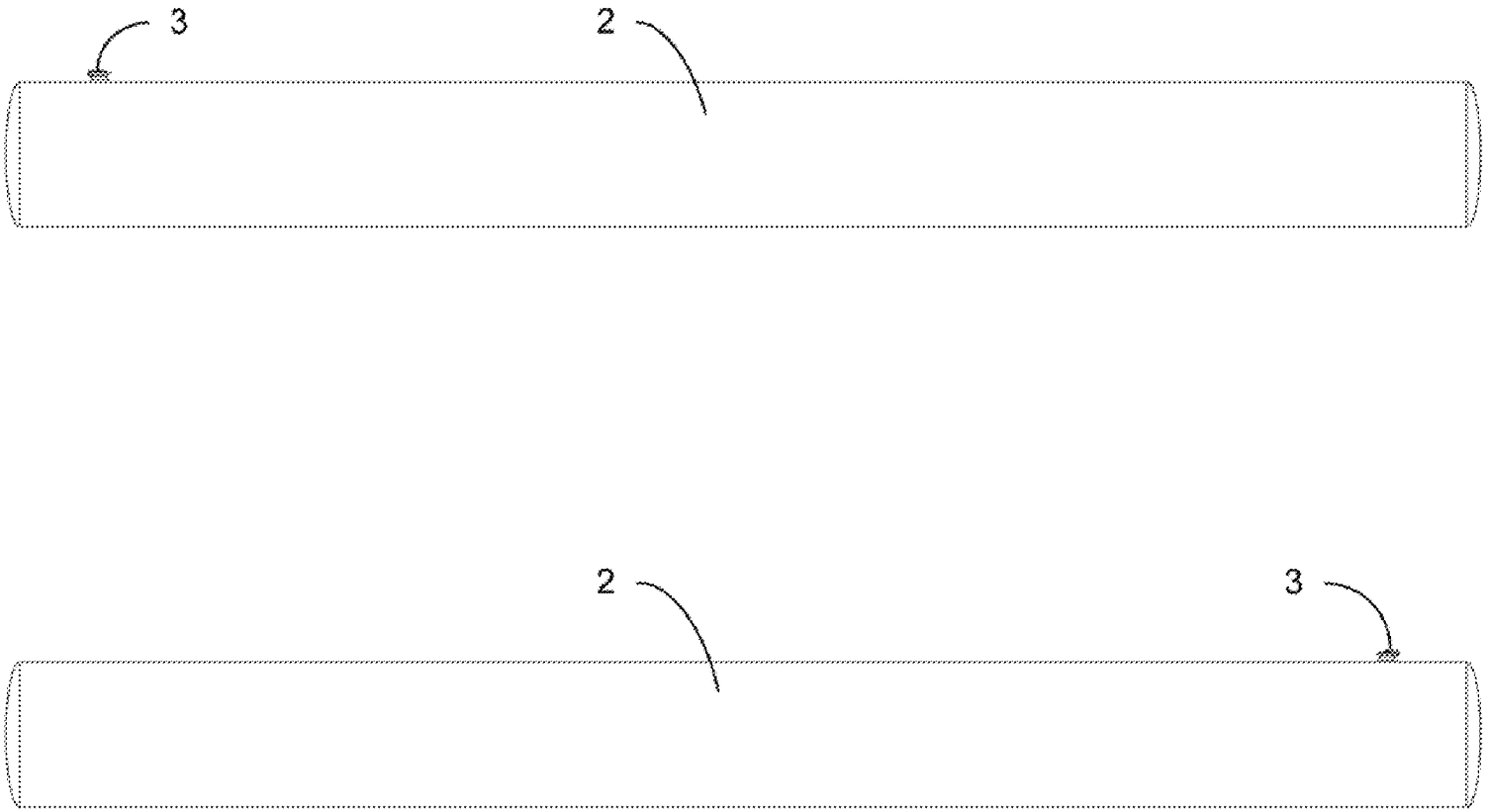
FIG. 3 is a side view of the bladder seen in FIG. 2.

FIG. 3 is a side view of a bladder (2) seen in FIG. 2. The placement of the valve (3) in the bladder (2) may be modified to adapt to any given watercraft.

Figure 4:
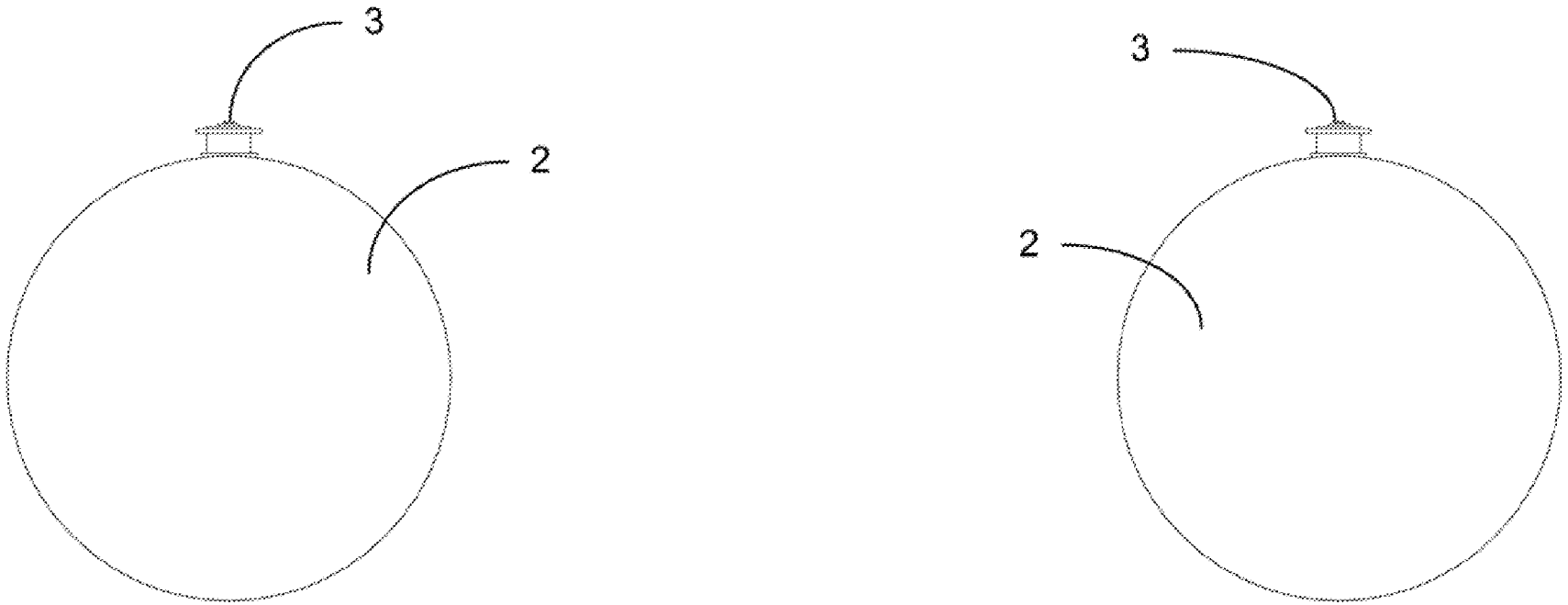
FIG. 4 is an end view of the bladder seen in FIG. 2.

FIG. 4 is an end view of the bladder (2) seen in FIG. 2. The ends of the bladder (2) are welded or attached in any suitable manner to the main body of the bladder (2).

In operation, the rounded design of the ends helps the overall bladder (2) shape remain as rounded as possible. This rounded shape helps to distribute the internal air pressure evenly throughout the bladder (2).

Figure 5:
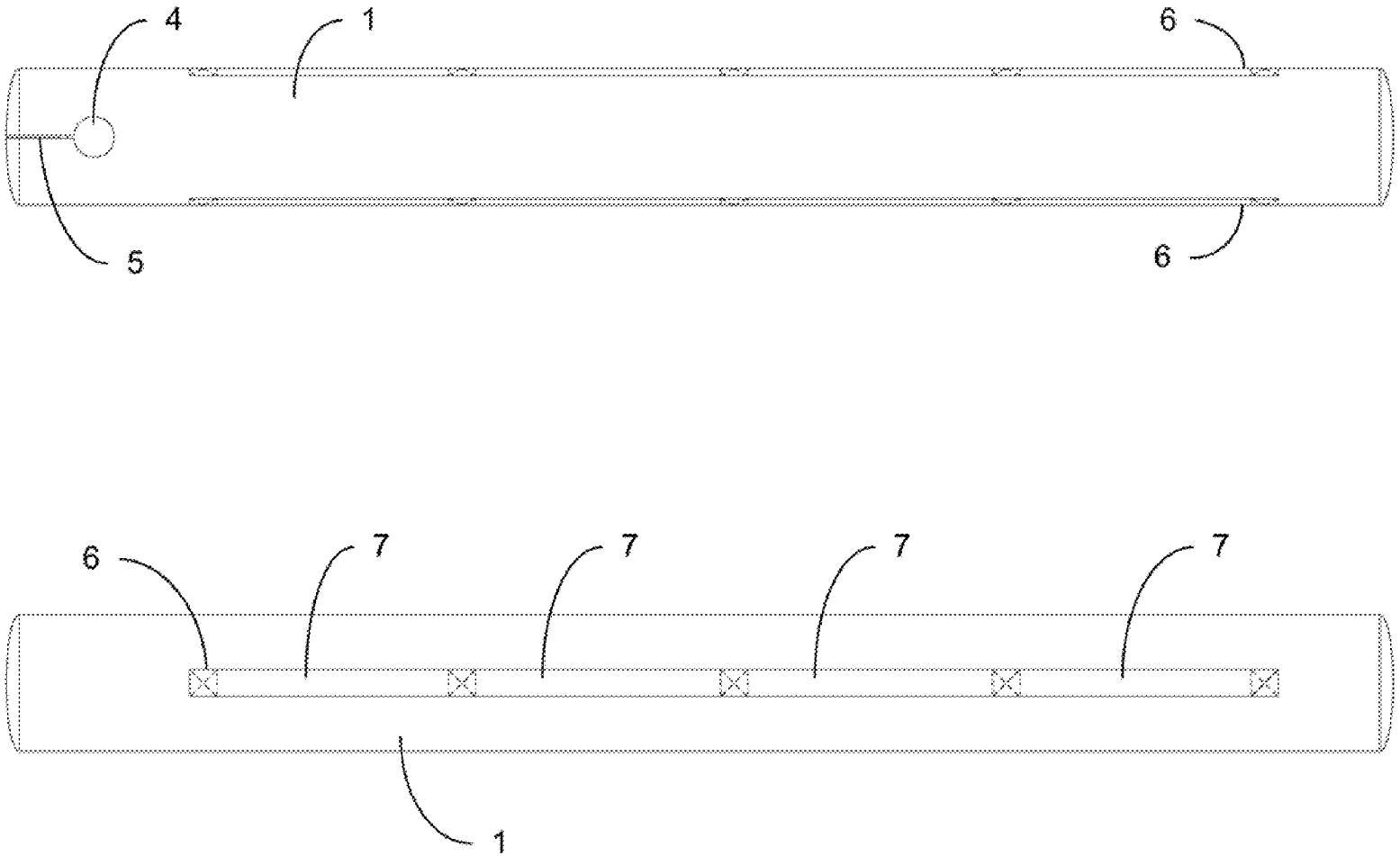
FIG. 5 is a top and bottom view of a cover for the bladder.

FIG. 5 is a top and bottom view of a cover (1) for the bladder (2). The cover (1) is fabricated from Denier nylon or any suitable heavy-duty, abrasion resistant, non-marring material. The valve access (4) provides protection as well as access to the valve (3). An optional loop strap (6) may be secured to the bottom of the cover (1) in the same manner as the loop straps (6) described in FIG. 6 and FIG. 7. The bladder access (5) opens into the valve access (4) providing for easy installation, removal and inspection of the bladder (2).

In operation, the cover (1) protects the bladder (2) from the elements and abrasion as well as providing a means for attaching the fender to the watercraft, dock, pier or other mooring point.

Figure 6:
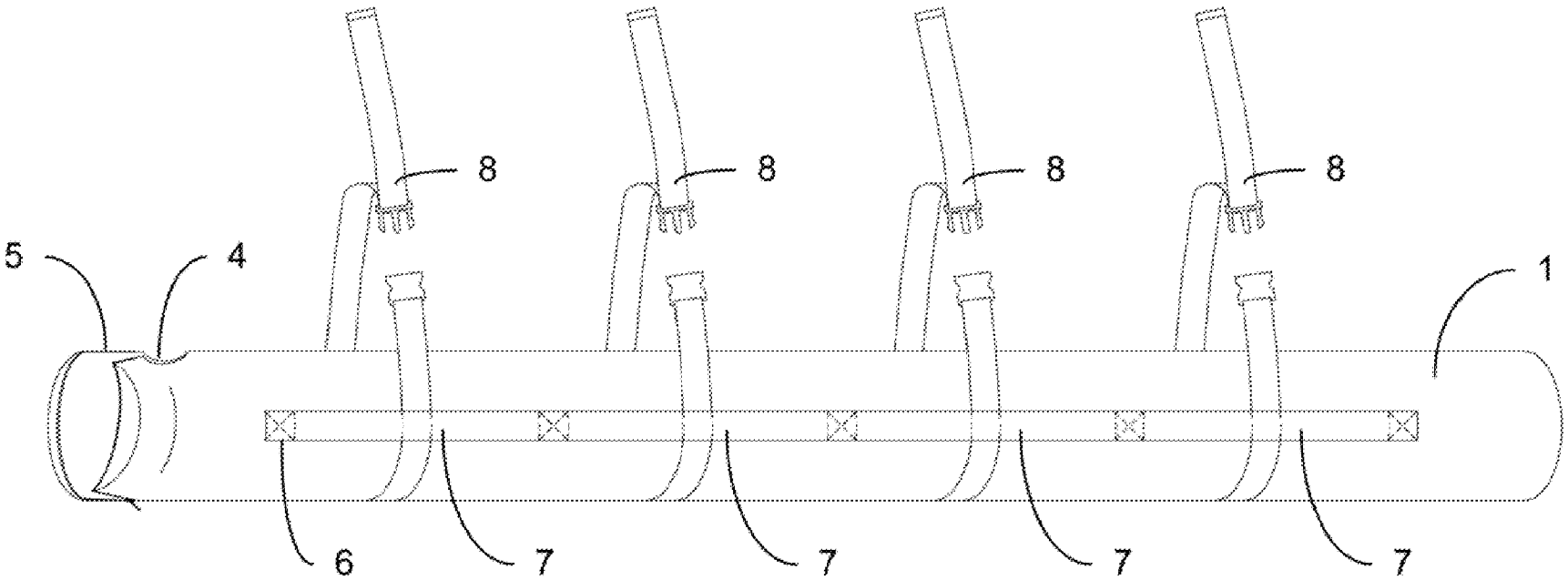
FIG. 6 is a side view of the cover for the bladder seen in FIG. 5 with the mooring straps inserted.

FIG. 6 is a side view of a cover (1) for the bladder (2) seen in FIG. 5 with mooring straps (8) inserted. Along the length of the inboard and outboard sides of the cover (1) are loop straps (6) fabricated of Denier nylon or any suitable heavy-duty, abrasion resistant, non-marring material. The loop straps (6) may be attached to the cover (1) in any suitable manner. An optional third loop strap (6) may be secured to bottom of the cover (1) as seen in FIG. 5. The inboard and outboard loop straps (6) are typically diametrically opposed to one another. The optional third loop strap (6) is 90° lateral to the inboard and outboard loop straps (6). Each loop strap (6) is secured to the cover (1) at both ends of the cover (1) as well as at regular intervals between the ends, creating a loops (7) at these intervals along the fill length of the loop strap (6). Each loop (7) is anchored to the cover (1) in such a manner that they are in alignment with the loops on the other loop straps (6).

Each mooring strap (8) is fabricated from Dernier nylon or any suitable, heavy-duty, abrasion resistant, non-marring material. On each end of the mooring strap (8) is a buckle or other suitable closure assembly that can be quickly and easily opened and closed, yet provide a secure connection. There is also provided a means for adjusting the length of the mooring strap (8).

In operation, individual mooring straps (8) are passed through corresponding individual loops (7) in the loop straps (6) along the length of the fender at locations that will provide even support and/or have suitable attachment points to the watercraft, dock or pier. They are then secured by fastening the integrated buckle or other suitable closure device. Each individual mooring strap (8) is lengthened or shortened to best accommodate the fender to the watercraft, dock, pier or pilings.

Figure 7:
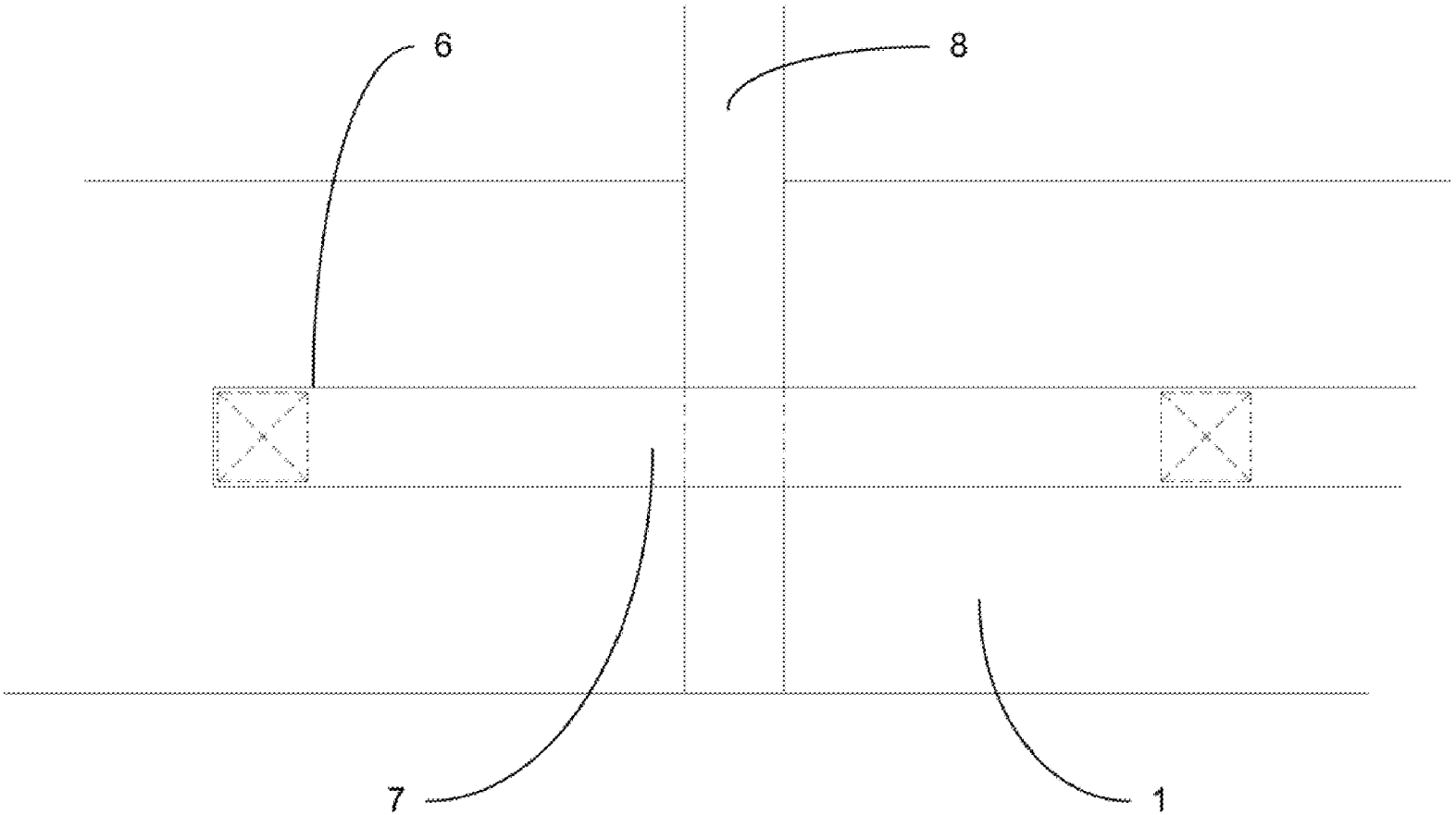
FIG. 7 is a detail view of a loop strap and mooring strap seen in FIG. 6.

FIG. 7 is a detail view of a loop strap (6) and mooring strap (8) seen in FIG. 6. The loop strap (6) is secured to the cover (1) in such a manner that the loop (7) created is large enough for the mooring strap (8) to pass through, yet will prevent the mooring strap (8) from sliding down the length of the fender.

In operation, the mooring strap (8) is passed through the corresponding loops (7) on the inboard, outboard (and optional bottom) sides of the cover (1).

Figure 8:
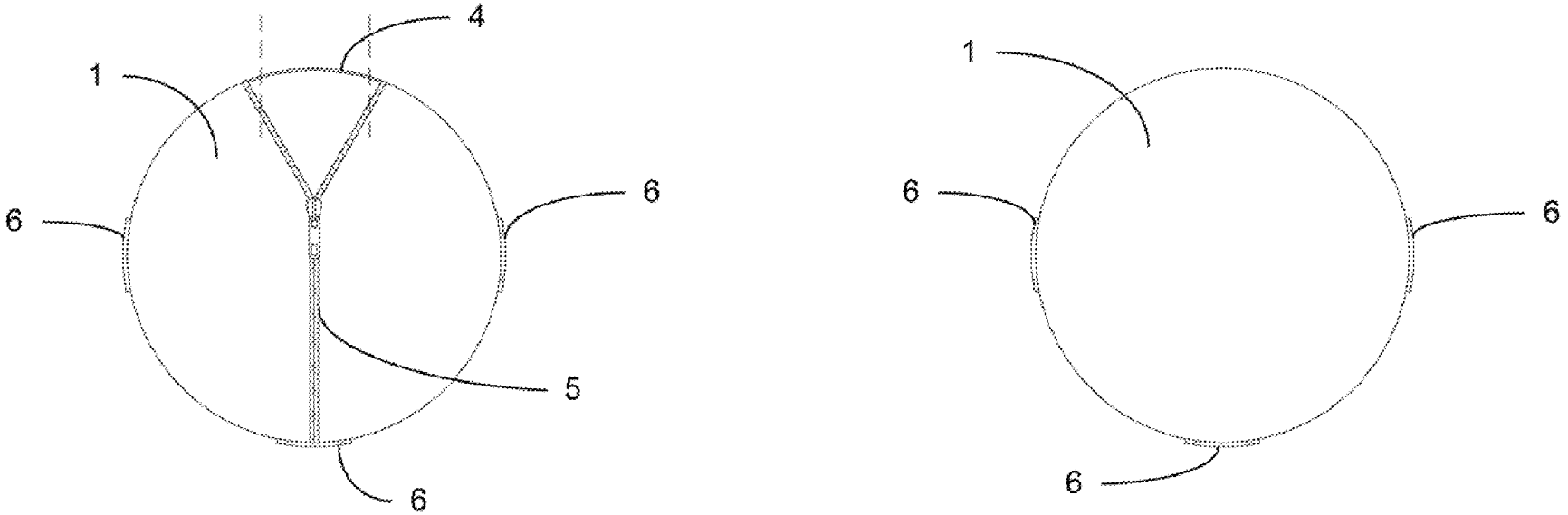
FIG. 8 is an end view of the cover seen in FIG. 5.

FIG. 8 shows end views of the cover (1) seen in FIG. 5. The broken lines represent the location of the valve access (4) which is hidden from view. The bladder access (5) can be a zipper, Velcro secured flap or any other suitable closure method. The bladder access (5) is the full height of the cover (1) and opens into the valve access (4) opening.

In operation, the bladder access (5) permits access to the bladder (2) for inspection or replacement.

Figure 9:
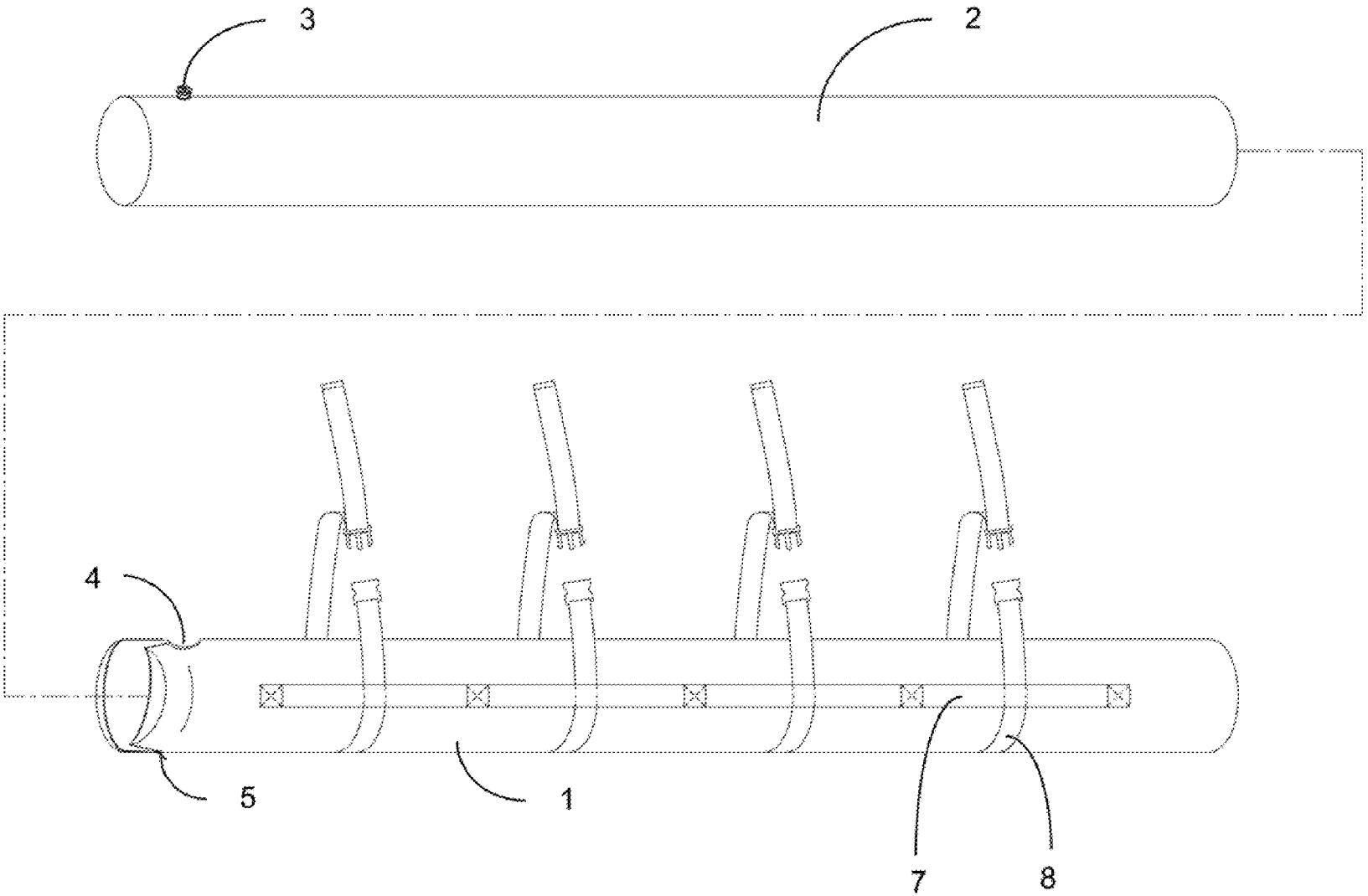
FIG. 9 is a side view of the bladder and cover for the bladder showing how the bladder is inserted into the cover.

FIG. 9 demonstrates how bladder (2) is inserted inside the cover (1). The bladder access (5) is opened and the end furthest from the valve (3) is inserted into the cover (1). When the bladder (2) is fully inserted inside the cover (1), the valve (3) will line up with the valve access (4). The bladder access (5) is then closed securing bladder (2) inside cover (1).

Figure 10:
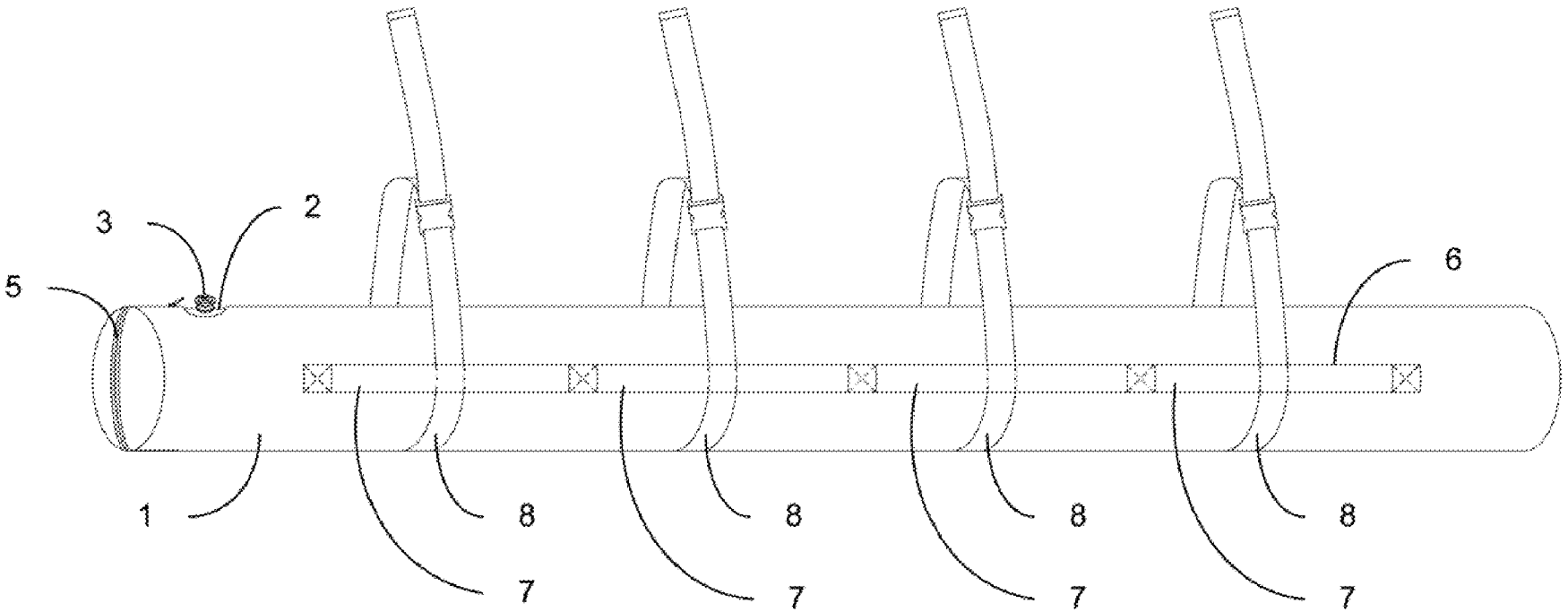
FIG. 10 is a side view of the bladder inside the cover.

FIG. 10 shows the bladder (2) secured inside the cover (1). The valve access (4) allows access to the valve (3) for deflating and deflating the bladder (2) while secured inside the cover (1).

Figure 11:
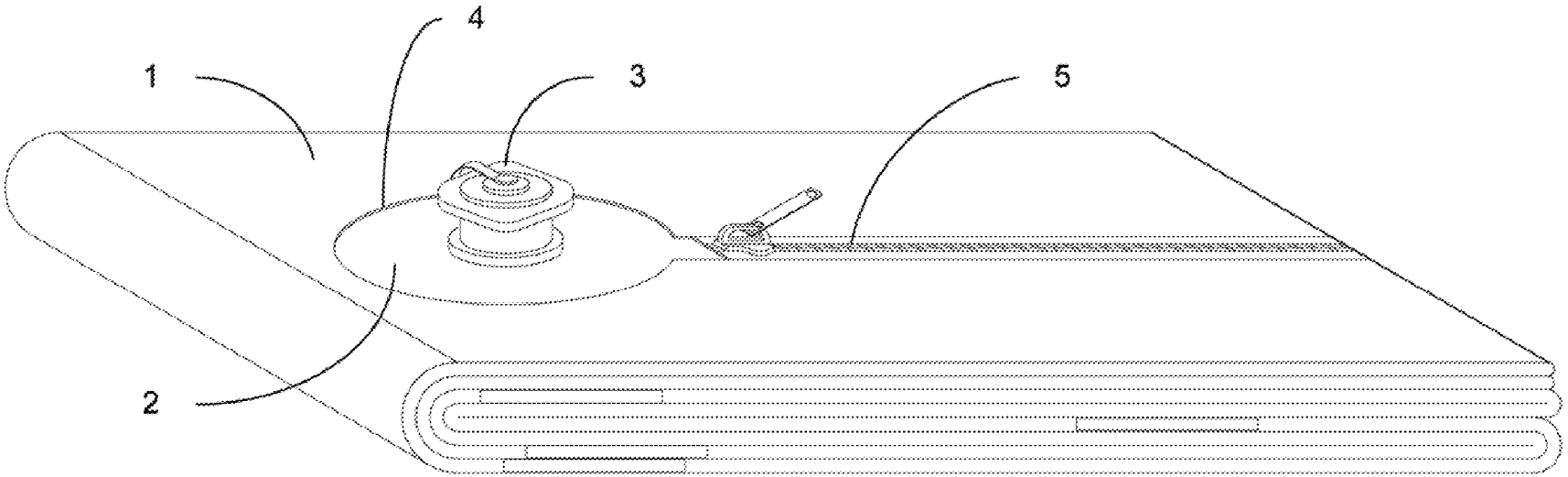
FIG. 11 is a side view of the bladder and cover folded for stowage.

FIG. 11 shows the bladder (2) and cover (1) with the bladder (2) deflated and folded for stowage.

Figure 12:
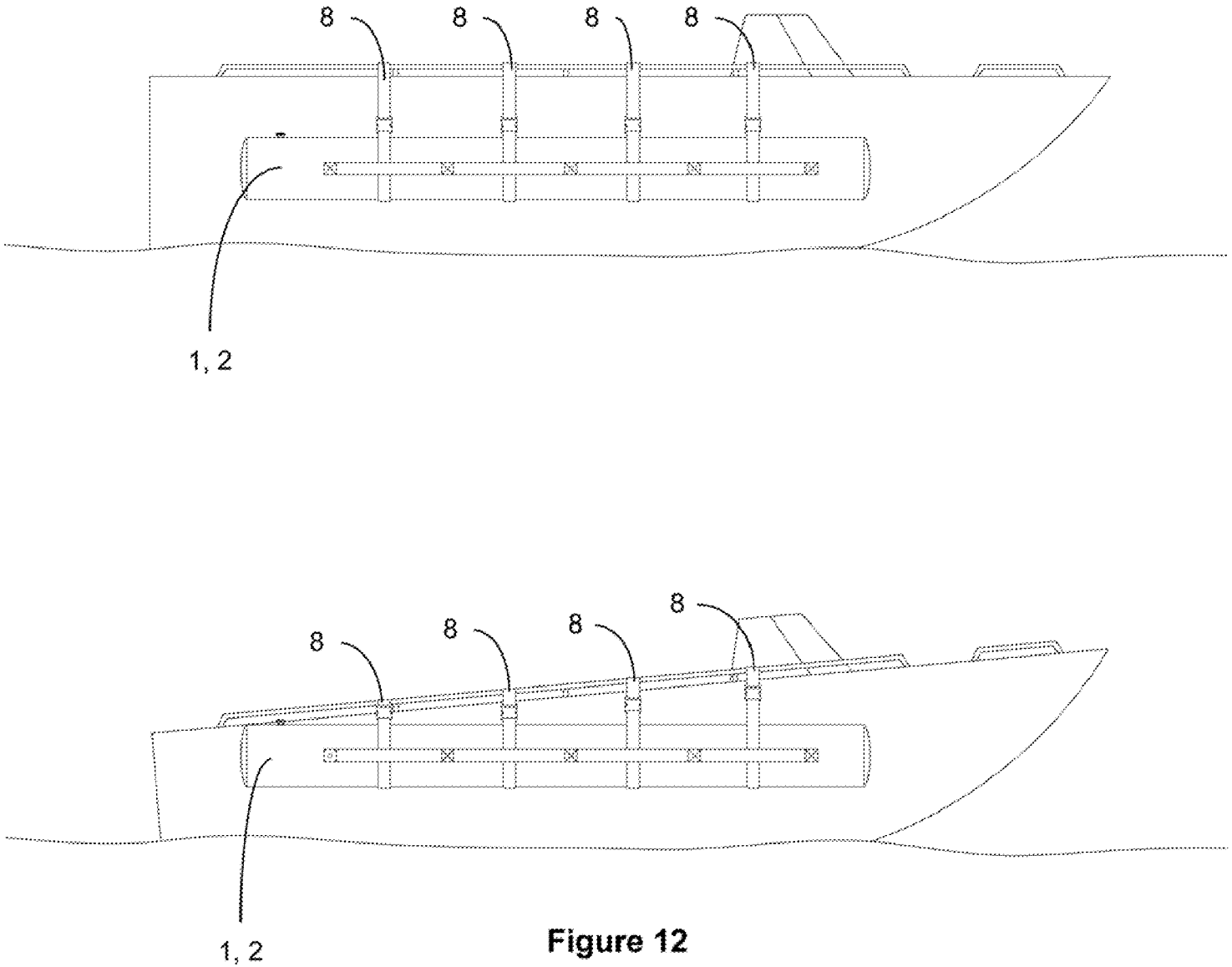
FIG. 12 are side views showing adiustment of the length of the mooring straps to best accommodate the fender to the watercraft, dock, pier or pilings.

FIG. 12 shows adjustment of the length of the mooring straps while the bladder (2) and cover (1) are attached to a watercraft to best accommodate the fender to the watercraft, dock, pier or pilings.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A watercraft fender for protecting a watercraft hull, comprising:

an inflatable bladder which absorbs shock when inflated;

wherein said inflatable bladder is airtight, lightweight, waterproof and buoyant;

a valve secured to said inflatable bladder for inflating and deflating said inflatable bladder;

a protective cover for enclosing said inflatable bladder;

at least one loop strap having two ends, said loop strap secured to said protective cover at each of said two ends and at regular intervals between said two ends creating a plurality of loops; and at least one mooring strap which passes through one of said plurality of loops, said loops preventing said at least one mooring strap from sliding down the length of said watercraft fender;

wherein said at least one mooring strap is used to secure said watercraft fender to a mooring point.

2. The watercraft fender for protecting a watercraft hull of claim 1, wherein said protective cover further includes a valve access for accessing said valve.

3. The watercraft fender for protecting a watercraft hull of claim 1 wherein said protective cover further includes a bladder access for securing said inflatable bladder inside said protective cover and for accessing said inflatable bladder while secured inside said protective cover.

4. A watercraft fender for protecting a watercraft hull, comprising:

an inflatable bladder which absorbs shock when inflated;

wherein said inflatable bladder is airtight, lightweight, waterproof and buoyant;

a valve secured to said inflatable bladder for inflating and deflating said inflatable bladder;

a protective cover for enclosing said inflatable bladder;

wherein said protective cover includes a valve access for accessing said valve and a bladder access for securing said inflatable bladder inside said protective cover and for accessing said inflatable bladder while secured inside said protective cover;

at least one loop strap having two ends, said loop strap secured to said protective cover at each of said two ends and at regular intervals between said two ends creating a plurality of loops; and at least one mooring strap which passes through one of said plurality of loops, said loops preventing said at least one mooring strap from sliding down the length of said watercraft fender;

wherein said at least one mooring strap is used to secure said watercraft fender to a mooring point.

5. The watercraft fender for protecting a watercraft hull of claim 1 wherein said valve is a Boston-style valve.

6. The watercraft fender for protecting a watercraft hull of claim 1 wherein said inflatable bladder has rounded ends to evenly distribute internal air pressure throughout said inflatable bladder.

7. The watercraft fender for protecting a watercraft hull of claim 3 wherein said bladder access is a zipper.

8. The watercraft fender for protecting a watercraft hull of claim 1 wherein said watercraft fender can be folded for stowage when deflated.

9. A method for protecting a watercraft hull using a watercraft fender comprised of the steps of:

inflating an inflatable bladder using a valve secured to said inflatable bladder;

wherein said inflatable bladder absorbs shock and is airtight, lightweight, waterproof and buoyant when inflated;

inserting said inflated inflatable bladder into a protective cover through a bladder access in said protective cover so that the location of said valve corresponds to the location of a valve access in said protective cover;

wherein said protective cover includes at least one loop strap having two ends, said loop strap secured to said protective cover at each of said two ends and at regular intervals between said two ends creating a plurality of loops;

securing said inflated inflatable bladder inside said protective cover;

inserting at least one mooring strap through one of said plurality of loops;

securing said at least one mooring strap to a mooring point; and adjusting the length of said at least one mooring strap so that said watercraft fender protects said watercraft hull.

* * * * *